US008006896B2

(12) United States Patent
Matsuura et al.

(10) Patent No.: US 8,006,896 B2
(45) Date of Patent: Aug. 30, 2011

(54) BANKNOTE HANDLING APPARATUS

(75) Inventors: Shinji Matsuura, Koto-Ku (JP); Yosuke Miyashita, Funabashi (JP)

(73) Assignee: Glory Ltd., Himeji-Shi (JP)

( * ) Notice: Subject to any disclaimer, the term of this patent is extended or adjusted under 35 U.S.C. 154(b) by 479 days.

(21) Appl. No.: 12/058,994

(22) Filed: Mar. 31, 2008

(65) Prior Publication Data

US 2009/0242624 A1 Oct. 1, 2009

(51) Int. Cl.
*G07F 19/00* (2006.01)

(52) U.S. Cl. ..... 235/379

(58) Field of Classification Search ..... 235/379, 235/375, 380; 902/8–10; 705/35, 43
See application file for complete search history.

(56) References Cited

U.S. PATENT DOCUMENTS

| | | | | |
|---|---|---|---|---|
| 5,544,043 | A * | 8/1996 | Miki et al. | 705/45 |
| 5,938,044 | A * | 8/1999 | Weggesser | 209/534 |
| 7,077,312 | B2 * | 7/2006 | Putman et al. | 235/379 |
| 7,187,795 | B2 * | 3/2007 | Jones et al. | 382/135 |
| 7,225,973 | B2 * | 6/2007 | McInally et al. | 235/379 |
| 7,644,039 | B1 * | 1/2010 | Magee et al. | 705/43 |
| 7,757,939 | B2 * | 7/2010 | Ireland et al. | 235/379 |

* cited by examiner

*Primary Examiner* — Seung H Lee
(74) *Attorney, Agent, or Firm* — Burr & Brown

(57) ABSTRACT

To improve the work efficiency of an operator, a banknote handling apparatus includes a first operating part that receives an instruction, a banknote handling section that handles banknotes on the basis of the instruction received by the first operating part, a first displaying part that is provided on the same surface as the first operating part, a second displaying part that is provided on a surface different from the surface of the first displaying part, and a controller that displays information on handling of the banknote handling section in the first and second displaying parts.

5 Claims, 6 Drawing Sheets

(B)

(A)

BANKNOTE HANDLING APPARATUS

BACKGROUND OF THE INVENTION

1. Field of the Invention

The present invention relates to a banknote handling apparatus and, more particularly, to a small-size banknote handling apparatus for performing the depositing, counting and the like of banknotes.

2. Related Art

Conventionally, in financial facilities such as banks, banknote handling apparatuses have hitherto been used to perform depositing. For example, a banknote receiving/paying machine disclosed in Japanese Patent Laid-Open Publication No. 9-106465 is known as a conventional banknote handling apparatus. This banknote receiving/paying machine is a desktop type that is used with being disposed on a desk. This banknote receiving/paying machine is provided with an operating part that receives operator instructions, a displaying part that displays results of depositing and the like, a receiving part that sets received banknotes, a stacker part that stacks banknotes delivered from the receiving part, discriminated and counted, and the like on one side of the machine body so that an operator can operate the machine disposed on the desk from this side while sitting.

For example, in financial facilities such as banks, the depositing of banknotes is performed at a counter. A counter of a bank is such that an operator and a customer sit face-to-face, with the counter interposed between the two persons. In general, a banknote handling apparatus is disposed on the counter in a position near the operator in such a direction that permits operations from the operator side (that is, the displaying part and the operating part face the operator). In such a case, in order for the operator to perform the operation of the banknote handling apparatus, results of the depositing of banknotes are displayed only on the displaying part that faces the operator. Therefore, the customer cannot see the results of the depositing. For this reason, in order to cause the results of the depositing to be seen by the customer, it is necessary for the operator to turn the banknote handling apparatus. As a result, this poses the problem that the work burden of the operator increases.

In financial facilities such as banks, the depositing of banknotes is performed also in a count room. In a count room of a bank, depositing large volumes of transactions is continuously performed by a dedicated operator. In the count room of a bank, the work condition of the operator is monitored by a monitoring camera and the like to watch whether or not the operator conducts fraudulent acts. In general, the monitoring camera is provided in a position where monitoring can be performed from above and before the operator in order to monitor the operator's face. In such a case, the displaying part of the banknote handling apparatus is in a position where the displaying part is not monitored by the monitoring camera. As a result, this poses the problem that even when errors and the like occur in the results of the depositing and/or the operator is conducting fraudulent acts, the information displayed in the displaying part of the banknote handling apparatus does not remain in images of the monitoring camera.

In contrast to this, it is possible to conceive a method that involves providing a monitoring camera for monitoring the displaying part of the banknote handling apparatus separately from a monitoring camera for monitoring the work condition of the operator. However, the number of monitoring cameras installed increases and this poses the problem that the work efficiency of the operator decreases.

SUMMARY OF THE INVENTION

The present invention has been made in view of circumstances as described above. According to the present invention, it is possible to simultaneously show information to an operator and a customer, to cause the work condition of the operator and information displayed in a displaying part to remain in images of a monitoring camera, and eventually to improve the work efficiency of the operator.

According to a first aspect of the present invention, there is provided a banknote handling apparatus, comprising:

a first operating part that receives an instruction;

a banknote handling section that handles banknotes on the basis of the instruction received by the first operating part;

a first displaying part that is provided on the same surface as the first operating part;

a second displaying part that is provided on a surface different from the surface of the first displaying part; and a controller that displays information on handling of the banknote handling section in the first and second displaying parts.

In the present invention, it is preferred that the banknote handling section further has a receiving part that receives banknotes into an internal portion thereof, and at least one stacking part that stacks the banknotes received by the receiving part.

In the present invention, it is preferred that the controller displays, in the second displaying part, suspect information showing that a suspect banknote has been handled when the suspect banknote has been handled by the banknote handling section.

In the present invention, it is preferred that the banknote handling apparatus further comprises a second operating part that is provided on the same surface as the second displaying part, wherein the controller displays a confirmation message to confirm whether or not handling results of the banknote handling section are accepted in the second displaying part, and wherein the second operating part has an acceptance key for accepting contents of the confirmation message displayed in the second displaying part.

In the present invention, it is preferred that the controller finishes handling of the banknote handling section when the acceptance key has been depressed.

In the present invention, it is preferred that the second displaying part is provided so as to permit angle adjustment.

In the present invention, it is preferred that the controller displays different kinds of information each in the first displaying part and the second displaying part.

In the present invention, it is preferred that the controller displays, in the second displaying part, a font larger than in the first displaying part.

In the present invention, it is preferred that the second displaying part is a light-emitting diode display device.

In the present invention, it is preferred that the banknote handling apparatus is used with being disposed on a desk.

DETAILED DESCRIPTION OF THE INVENTION

An embodiment of the present invention will be described below with reference to the drawings. Incidentally, the embodiment described below is one embodiment of the present invention and does not limit the scope of the present invention.

The embodiment of the present invention is an example of a banknote handling apparatus equipped with a plurality of displaying parts provided on different surfaces.

Figure 1:
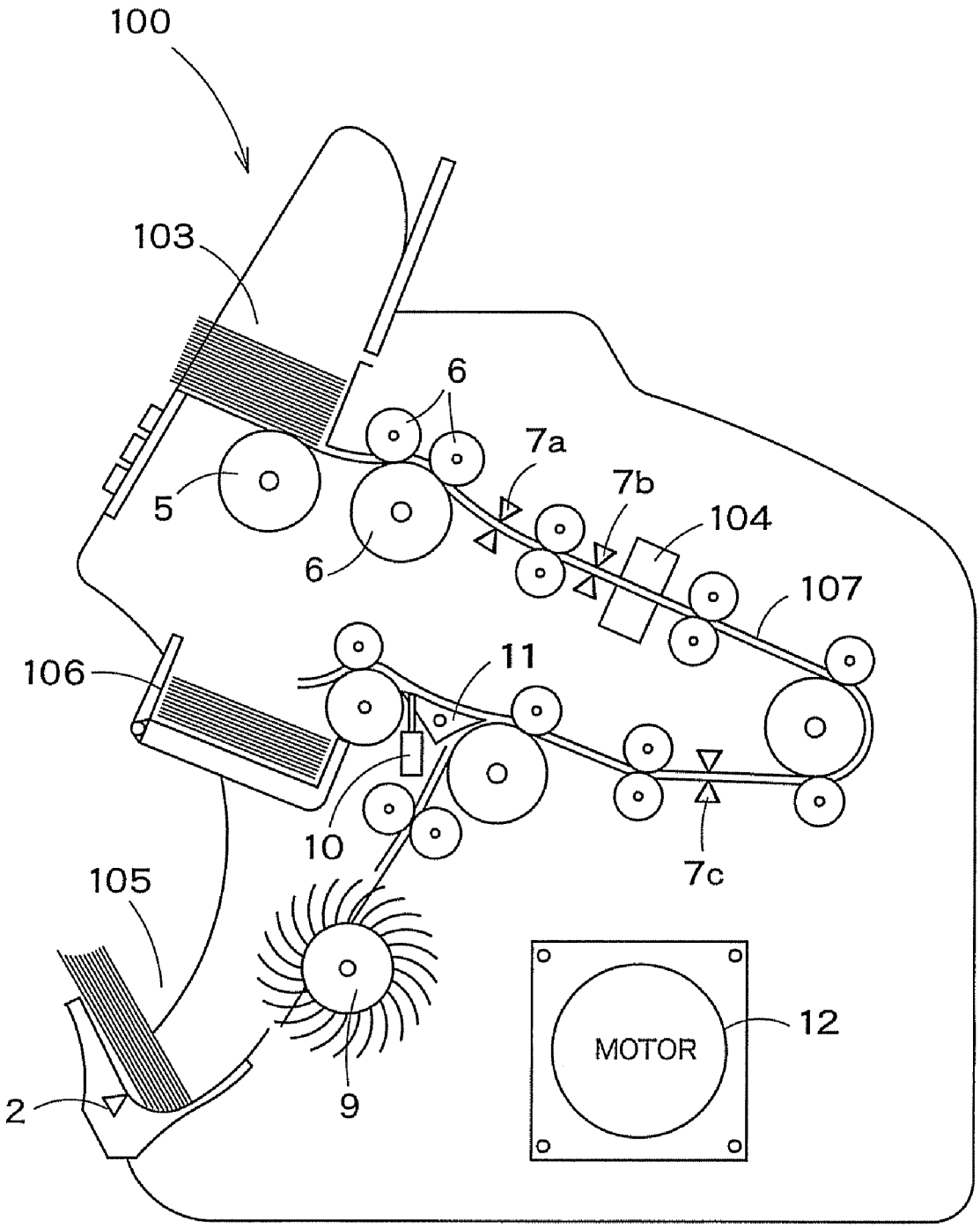
FIG. 1 is a schematic diagram showing the internal configuration of a banknote handling apparatus 100.
Figure 2:
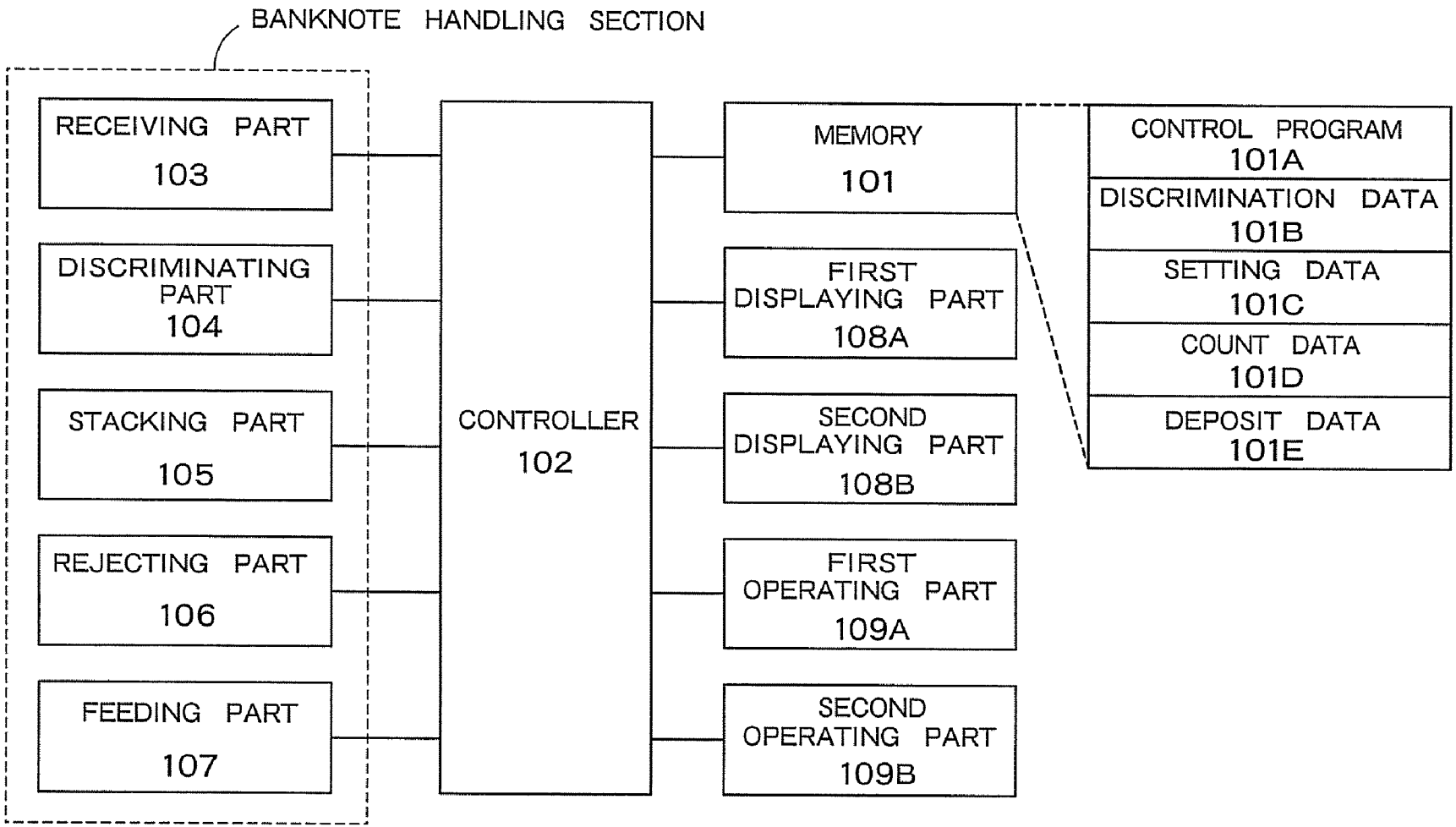
FIG. 2 is a block diagram showing control blocks of the banknote handling apparatus 100.

First, the configuration of a banknote handling apparatus 100 will be described with reference to FIGS. 1 and 2. FIG. 1 is a schematic diagram showing the internal configuration of the banknote handling apparatus 100, and FIG. 2 is a block diagram showing control blocks of the banknote handling apparatus 100.

As shown in FIG. 1, the banknote handling apparatus 100 is provided with a banknote handling section that includes a receiving part 103, a discriminating part 104, a stacking part 105, a rejecting part 106 and a feeding part 107. As shown in FIG. 2, the banknote handling apparatus 100 is further provided with a memory 101, a controller 102, first and second displaying parts 108A, 108B, and first and second operating parts 109A, 109B.

The memory 101 stores a control program 101A, discrimination data 101B, setting data 101C, count data 101D and deposit data 101E. The memory 101 functions also as the working memory for the controller 102.

The controller 102 is connected to each of the parts 101, 103 to 109 of the banknote handling apparatus 100. The controller 102 controls each of the parts 103 to 109 of the banknote handling apparatus 100 by starting the control program 101A stored in the memory 101.

The receiving part 103 receives banknotes to inside the banknote handling apparatus 100.

The discriminating part 104 discriminates the banknotes received by the receiving part 103, and writes discrimination results as the discrimination data 101B on the memory 101.

The stacking part 105 stacks banknotes that have been judged to be banknotes to be fed to the stacking part 105 (hereinafter called "normal banknotes") on the basis of each kind of the data 101B to 101E stored in the memory 101 by the controller 102. A banknote for which a factor responsible for rejection (for example, kinds of banknote except a specified kind of banknote, directions except a specified direction (front or back surface, direction), damaged banknotes, suspect banknotes and the like) has not been identified by the discriminating part 104 is judged to be a normal banknote.

The rejecting part 106 stacks banknotes not to be fed to the stacking part 105 (hereinafter called "rejected banknotes") on the basis of each kind of the data 101B to 101E stored in the memory 101 by the controller 102. A banknote for which a factor for rejection has been identified by the discriminating part 104 is judged to be a rejected banknote.

The feeding part 109 feeds the banknotes received by the receiving part 103 to the stacking part 105 or the rejecting part 106 on the basis of judgment results of the controller 102.

The first and second displaying parts 108A, 108B are display devices that display prescribed information to the operator or the customer. For example, the display devices are light-emitting diode (hereinafter called "LED") display devices.

The first and second operating parts 109A, 109B have keys that receive instructions from the operator or the customer. The first and second operating parts 109A, 109B receive setting instructions to the banknote handling apparatus 100 and write the contents of the received instructions as setting data 101C on the memory 101.

Figure 3:
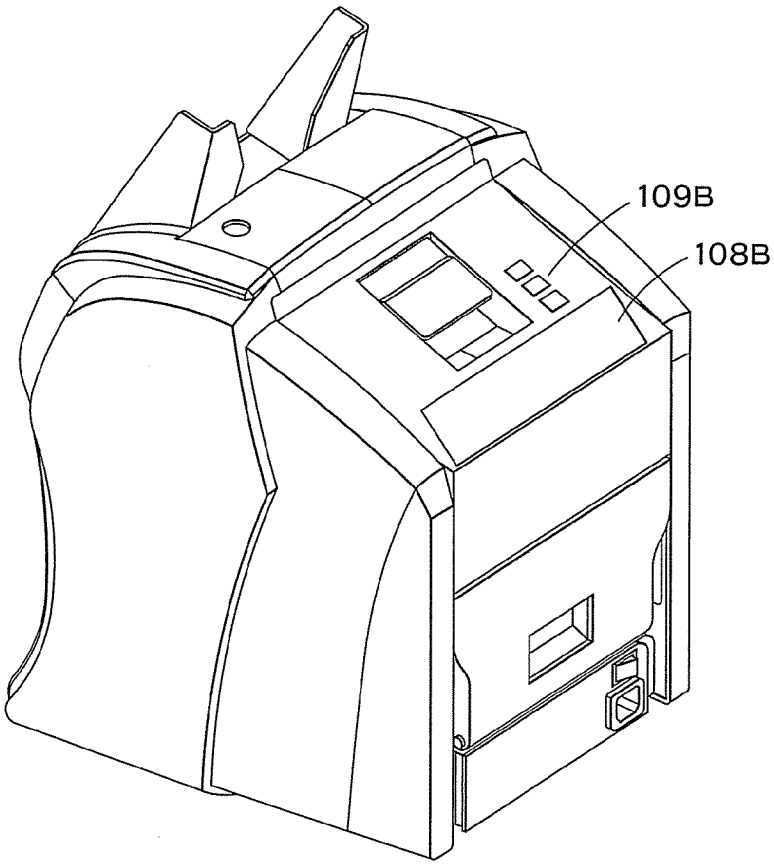
FIGS. 3(A) and 3(B) are perspective views showing an example of the positional relationships between first and second displaying parts 108A and 108B and between first and second operating parts 109A and 109B.
Figure 3:
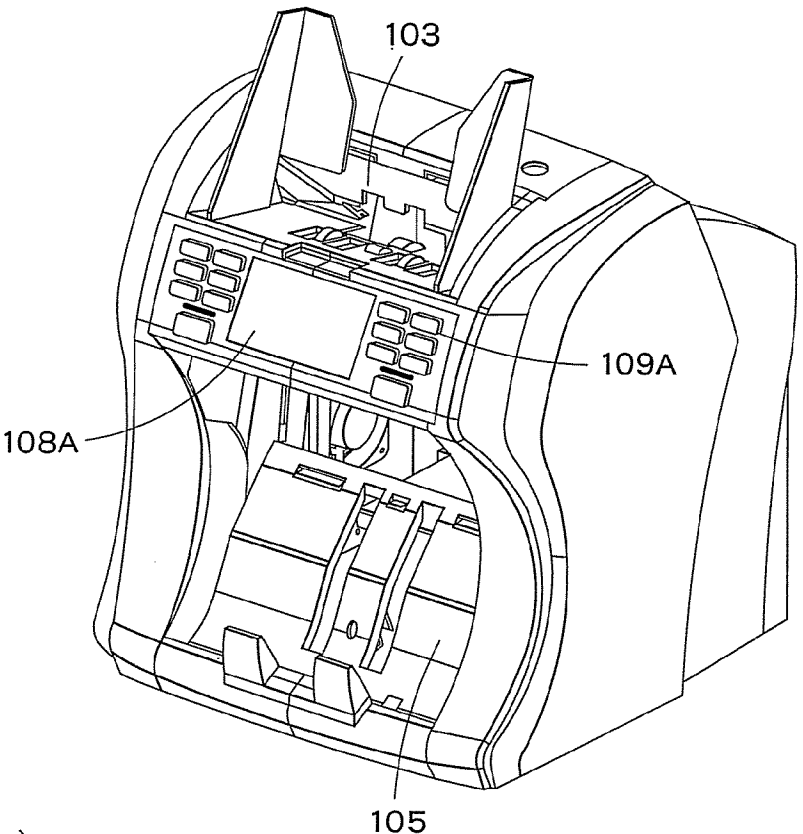

FIGS. 3(A) and 3(B) are perspective views showing an example of the positional relationships between the first and second displaying parts 108A and 108B and between the first and second operating parts 109A and 109B.

As shown in FIG. 3(A), the first displaying part 108A and the first operating part 109A are provided on the same surface (hereinafter called "a first surface") as the receiving part 103 and stacking part 105 of the banknote handling apparatus 100. Because the banknote handling apparatus 100 is disposed so that the first surface faces the operator side, the first operating part 109A receives operator's instructions and the first displaying part 108A displays prescribed information to the operator.

As shown in FIG. 3(B), on the surface different from the first surface (hereinafter called "a second surface"), the second displaying part 108B and the second operating part 109B are provided. Because on a counter in financial facilities such as banks, the banknote handling apparatus 100 is disposed so that the second surface faces the customer side, the second operating part 109B receives customer's instructions and the second displaying part 108B displays prescribed information to the customer. In a count room of financial facilities such as banks, the banknote handling apparatus 100 is disposed so that the second surface faces a direction different from the operator side, it is possible to dispose a monitoring camera so that the information displayed on the second displaying part 108B can be easily monitored.

Alternatively, the second displaying part 108B may be provided so as to permit angle adjustment in order to ensure that the second displaying part 108B can be easily seen from the customer or can be easily monitored from the monitoring camera. Further, the second displaying part 108B may display information for the customer or for the monitoring camera (i.e., information different from the information displayed on the first displaying part 108A). Further, the second displaying part 108B may display a font larger than in the first displaying part 108A so that the information can be easily seen from the customer or can be easily monitored from the monitoring camera.

Next, the operation of the banknote handling apparatus 100 will be described with reference to FIG. 1.

As shown in FIG. 1, banknotes set in the receiving part 103 are taken into the interior of the banknote handling apparatus 100 sheet by sheet by the rotation of a delivery roller 5. The taken banknotes are caused to pass through the discriminating part 104 by the rotation of a feed roller 6. At this time, the kinds of banknotes are discriminated at a prescribed point in time after the detection by tracking sensors 7*a*, 7*b*. The banknotes that have passed through the discriminating part 104 are fed to the stacking part 105 or the rejecting part 106 via a branch lever 11. At this time, a solenoid 10 causes the branch lever 11 to be driven at a prescribed point in time after the detection by a tracking sensor 7*c*. Banknotes that have been judged to be normal banknotes are caused to branch into the stacking part 105 via an impeller 9, and banknotes that have been judged to be rejected banknotes are caused to branch so as to be fed to the rejecting part 106. For the banknotes that have been stacked in the stacking part 105, the remaining condition of these banknotes is detected by a remaining banknote detecting sensor 2. Each of the above-described parts is driven by a motor 12.

Figure 4:
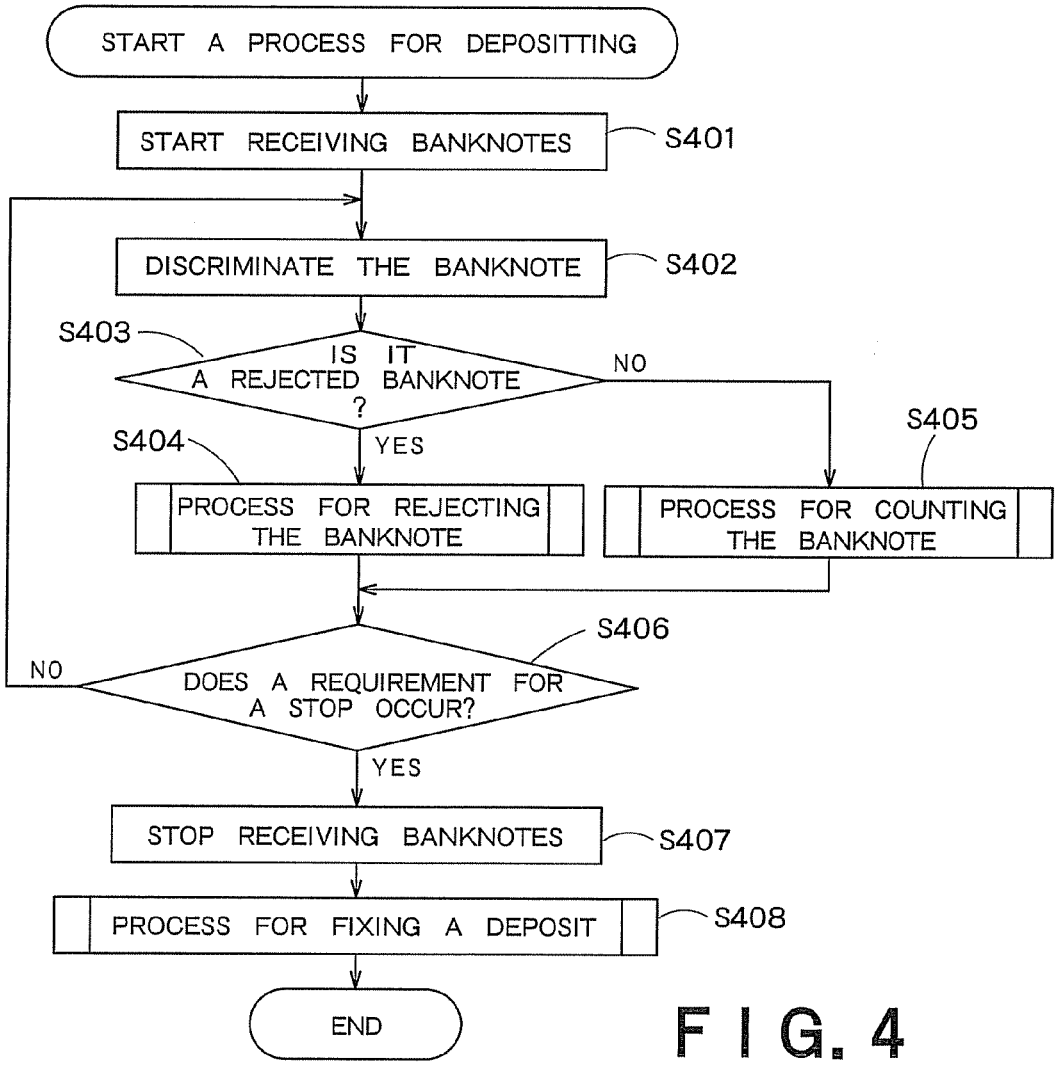
FIG. 4 is a flowchart showing a processing procedure for depositing.

Next, details of the handling by the banknote handling apparatus 100 will be described with reference to FIGS. 4 to 10. FIG. 4 is a flowchart showing a processing procedure for a process for depositing.

First, the receiving part 103 starts receiving banknotes for receiving the banknotes to the interior of the banknote handling apparatus 100 (S401). For example, when a start key of the first operating part 109A is depressed, the receiving of the banknotes is started.

Then, the discriminating part 104 discriminates the banknotes that have been received by the receiving part 103 and writes discrimination results on the memory 101 as discrimination data 101B (S402).

When a banknote has been judged to be a rejected banknote on the basis of the discrimination results of S402 (S403-YES), the controller 102 performs a process for rejecting the banknote (reference FIG. 5), which will be described later (S404).

On the other hand, when a banknote has been judged to be a normal banknote on the basis of the discrimination results of S402 (S403-NO), the controller 102 performs a process for counting the banknote (reference FIG. 8), which will be described later (S405).

The steps S402 to S405 are repeatedly performed until a requirement for a stop occurs (S406-NO).

When the requirement for a stop has occurred (S406-YES), the receiving part 103 stops receiving banknotes (S407). For example, the requirement for a stop occurs when there is no banknote any more in the receiving part 103, when an instruction for a stop has been received by the first or second operating part 109A, 109B, or when a prescribed number of banknotes have been stacked in the stacking part 105.

Then, the controller 102 performs a process for fixing a deposit, which will be described later, and the process for depositing is finished (S408).

Figure 5:
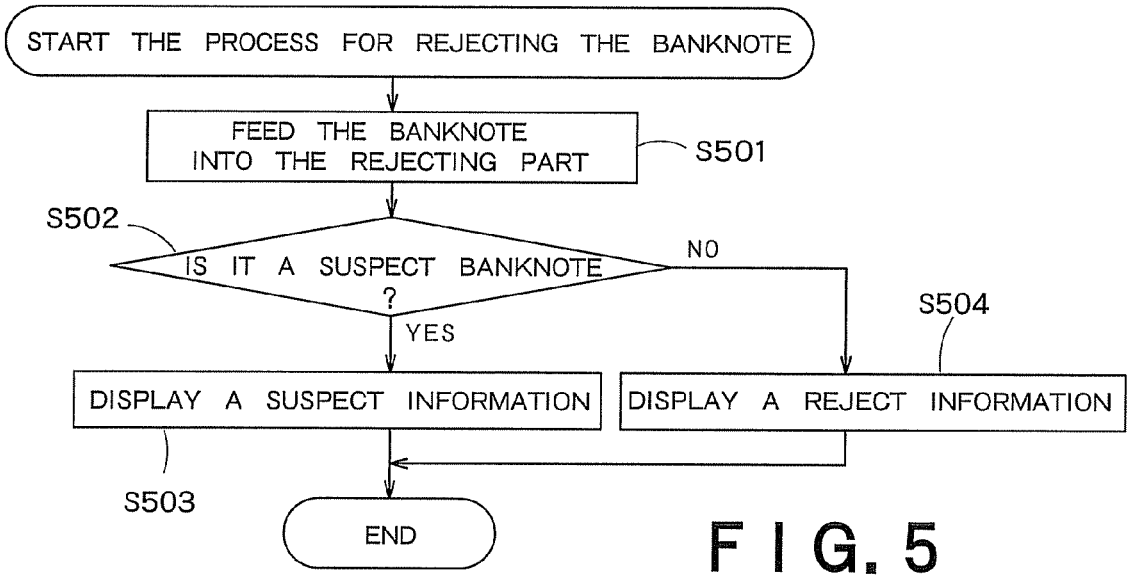
FIG. 5 is a flowchart showing a processing procedure for a process for rejecting the banknote (S404 of FIG. 4)

FIG. 5 is a flowchart showing a processing procedure for a process for rejecting the banknote (S404 of FIG. 4).

First, the feeding part 107 feeds the banknote that has been received at S401 of FIG. 4 into the rejecting part 106 (S501).

Figure 6:
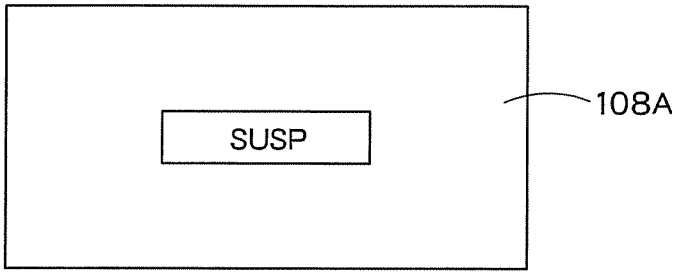
FIG. 6 is a schematic diagram showing an example of suspect information displayed on the first displaying part 108A.

When the discrimination results at S402 of FIG. 4 reveal a suspect banknote (S502-YES), the controller 102 displays information indicating that the banknote fed into the rejecting part 106 at S501 is a suspect banknote (hereinafter called "suspect information") to at least one of the first and second displaying parts 108A, 108B (S503). For example, suspect information as shown in FIG. 6 is displayed only in the first displaying part 108A.

Figure 7:
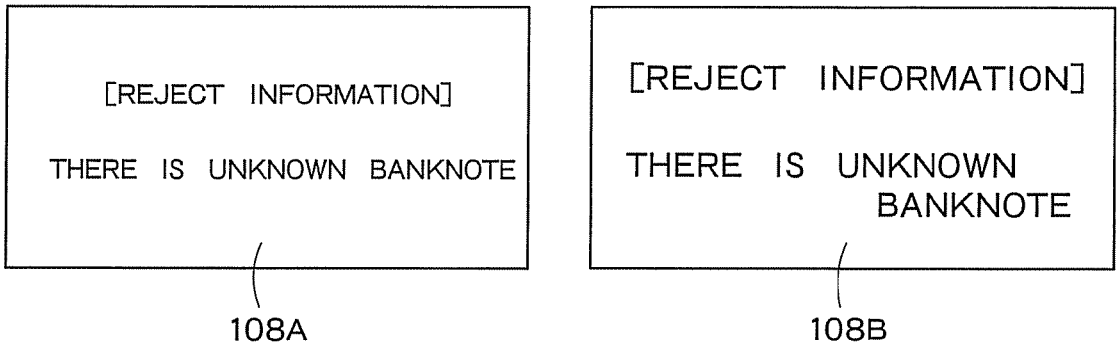
FIG. 7 is a schematic diagram showing an example of reject information displayed in the first and second displaying parts 108A, 108B.

On the other hand, when the discrimination results at S402 of FIG. 4 reveal a factor responsible for rejection other than a suspect banknote (for example, kinds of banknote except a specified kind of banknote, directions except a specified direction (front or back surface, direction), damaged banknotes and the like)(S502-NO), the controller 102 displays information indicating a factor responsible for rejection (hereinafter called "rejection information") in the first and second displaying parts 108A, 108B. For example, reject information as shown in FIG. 7 is displayed in the first and second displaying parts 108A, 208B. At this time, a font larger than in the first displaying part 108A is displayed in the second displaying part 108B.

The process for rejecting the banknote is finished after S503 and S504.

Figure 8:
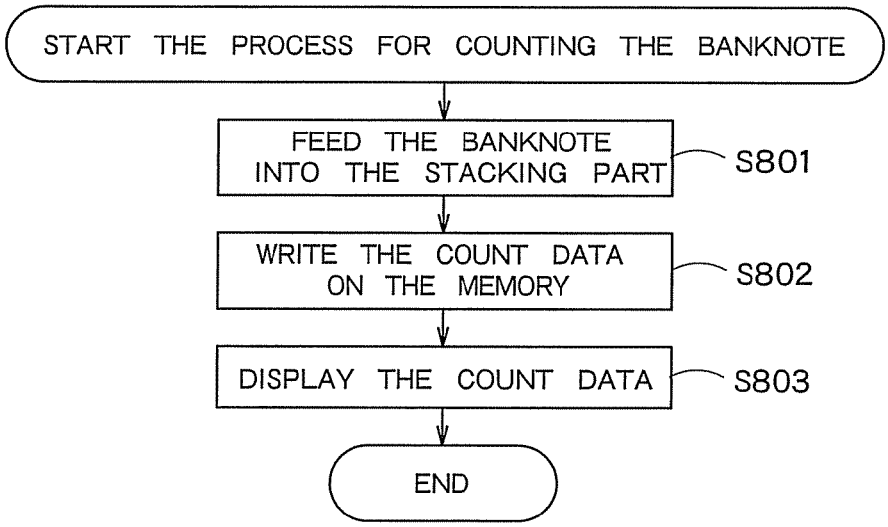
FIG. 8 is a flowchart showing a processing procedure for a process for counting the banknote (S405 of FIG. 4)

FIG. 8 is a flowchart showing a processing procedure for a process for counting the banknote (S405 of FIG. 4).

First, the feeding part 107 feeds the banknote that has been received at S401 of FIG. 4 into the stacking part 105 (S801).

Then, the discriminating part 104 writes count results of the banknote fed into the stacking part 105 at S801 on the memory 101 as count data 101D on the basis of the discrimination results at S402 of FIG. 4 (S802).

Then, the controller 102 displays the count data 101D written on the memory 101 at S802 as count information in the first and second displaying parts 108A, 108B, and the process for counting is finished (S803).

Figure 10:
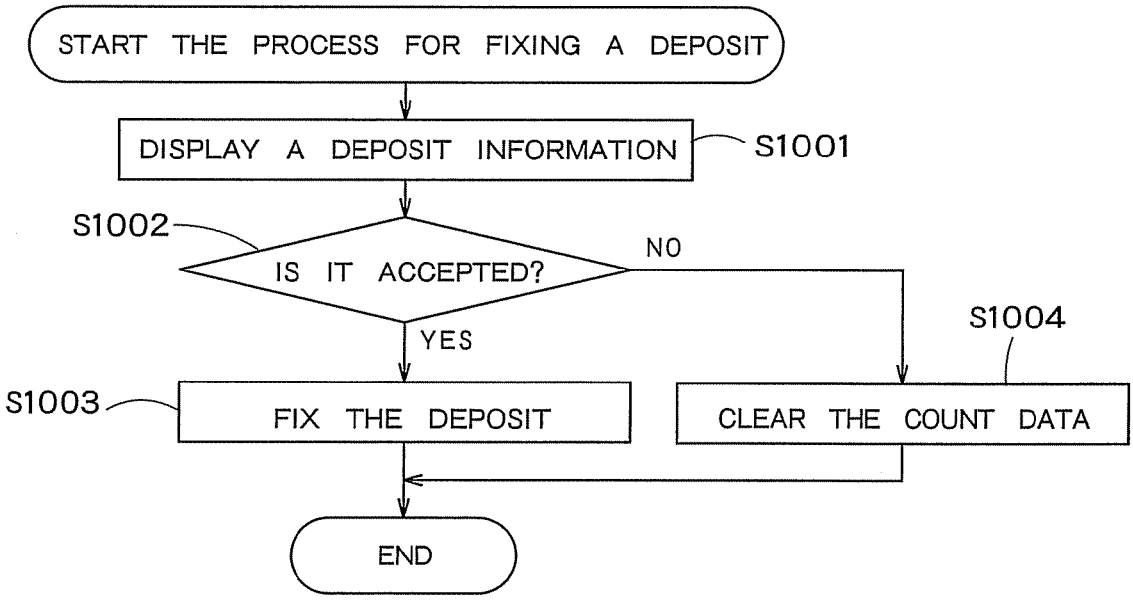
FIG. 10 is a flowchart showing a processing procedure for a process for fixing a deposit (S408 of FIG. 4).

FIG. 10 is a flowchart showing a processing procedure for a process for fixing a deposit (S408 of FIG. 4).

Figure 9:
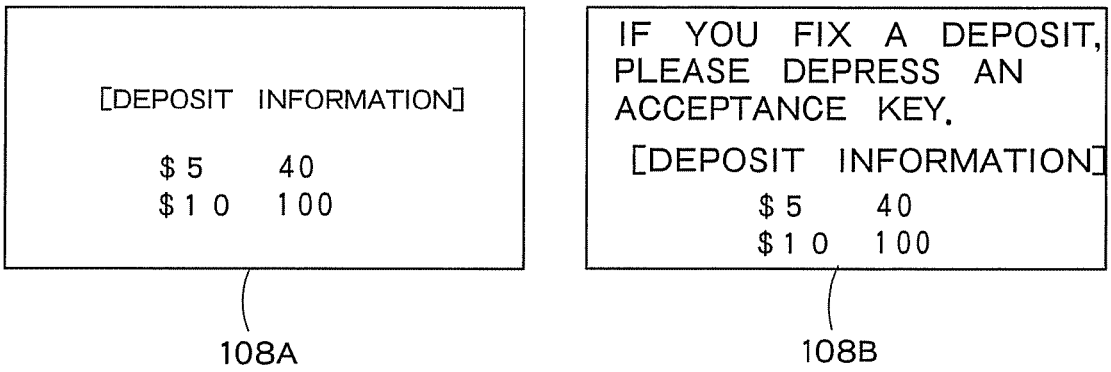
FIG. 9 is a schematic diagram showing an example of deposit information and a confirmation message displayed in the first and second displaying parts 108A, 108B.

First, the controller 102 displays information indicating the count data 101D at a point in time when the requirement for a stop occurred (hereinafter called "deposit information") in the first and second displaying parts 108A, 108B (S1001). For example, as shown in FIG. 9, deposit information is displayed in the first displaying part 108A and deposit information and a confirmation message are displayed in the second displaying part 108B.

When the deposit information has been accepted (for example, when an acceptance key of the second operating part 109B has been depressed)(S1002-YES), the deposit is fixed by writing the count data 101D stored in the memory 101 as the deposit data 101E (S1003).

On the other hand, when the deposit information has not been accepted (for example, a clear key of the second operating part 109B has been depressed) (S10020-NO), the count data 101D is cleared from the memory 101 (S1004).

The process for fixing a deposit is finished after S1003, S1004.

According to the embodiment of the present invention, prescribed information is displayed not only in the first displaying part 108A, but also in the second displaying part 108B provided on a surface different from the surface of the first displaying part 108A. Therefore, it is possible to simultaneously indicate information to the operator and the customer. Furthermore, it is also possible to cause the information indicated in the second displaying part 108B to remain in images of the monitoring camera. As a result, it is unnecessary to cause the operator to rotate the banknote handling apparatus 100 in order to show deposit results to the customer and it is also unnecessary to dispose the monitoring camera for monitoring the first displaying part 108A of the banknote handling apparatus 100 on the operator side, with the desirable result that the work efficiency of the operator can be improved.

What is claimed is:

1. A banknote handling apparatus, comprising:

a first operating part that receives an instruction;

a banknote handling section that handles banknotes on the basis of the instruction received by the first operating part;

a first displaying part that is provided on the same surface as the first operating part;

a second displaying part that is provided on a surface different from the surface of the first displaying part, wherein an acceptance key for accepting a handling result of the banknote handling section displayed on the second displaying part is provided on the same surface as the second displaying part; and a controller that displays information on handling of the banknote handling section in the first and second displaying parts.

2. The banknote handling apparatus according to claim 1, wherein the banknote handling section further has a receiving part that receives banknotes into an internal portion thereof, and at least one stacking part that stacks the banknotes received by the receiving part.

3. The banknote handling apparatus according to claim 1, wherein the controller displays a confirmation message to confirm whether or not handling results of the banknote handling section are accepted in the second displaying part.

4. The banknote handling apparatus according to claim 1, wherein the controller finishes handling of the banknote handling section when the acceptance key has been depressed.

5. The banknote handling apparatus according to claim 1, wherein the banknote handling apparatus is used with being disposed on a desk.

* * * * *